US010824091B2

(12) United States Patent
Takai et al.

(10) Patent No.: US 10,824,091 B2
(45) Date of Patent: Nov. 3, 2020

(54) DEVELOPMENT DEVICE AND IMAGE FORMING APPARATUS

(71) Applicant: KYOCERA Document Solutions Inc., Osaka (JP)

(72) Inventors: Hiroaki Takai, Osaka (JP); Hiroaki Ohashi, Osaka (JP); Hirofumi Tsuji, Osaka (JP); Masahiro Ueno, Osaka (JP); Yasutaka Hashimoto, Osaka (JP); Tomoyasu Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/775,940

(22) Filed: Jan. 29, 2020

(65) Prior Publication Data

US 2020/0264533 A1 Aug. 20, 2020

(30) Foreign Application Priority Data

Feb. 19, 2019 (JP) ..... 2019-027749

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0865
See application file for complete search history.

(56) References Cited

U.S. PATENT DOCUMENTS 7,257,347 B2 * 8/2007 Okamoto ..... G03G 15/0875 399/109
8,335,451 B2 * 12/2012 Kim ..... G03G 21/1828 399/103
8,355,648 B2 * 1/2013 Hirukawa ..... G03G 21/1832 399/106
8,811,859 B2 * 8/2014 Tsuritani ..... G03G 15/0877 399/254

FOREIGN PATENT DOCUMENTS

JP H0511667 A 1/1993

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A development device includes a rotational member and a housing. The rotational member rotates around an axis. In the housing, the rotational member and a toner are stored. The housing includes a lower housing and an upper housing. The lower housing has a concave first storage part having an opened upper face. The upper housing has a concave second storage part having an opened lower face. The first storage part has a first edge portion around the opened upper face. The first edge portion has a first contact face. The second storage part has a second edge portion around the opened lower face. The second edge portion has a second contact face coming into contact with the first contact face. The first contact face and the second contact face are contained in a single plane along respective entire circumferences.

7 Claims, 14 Drawing Sheets

II - II

II - II

II - II

DEVELOPMENT DEVICE AND IMAGE FORMING APPARATUS

INCORPORATION BY REFERENCE

This application is based on and claims the benefit of priority from Japanese patent application No. 2019-027749 filed on Feb. 19, 2019, which is incorporated by reference in its entirety.

BACKGROUND

The present disclosure relates to a development device which develops an electrostatic latent image by a toner and an image forming apparatus including the development device.

An electrophotographic type image forming apparatus is provided with a development device which develops an electrostatic latent image by a toner. As shown in FIG. 13A to FIG. 14, the conventional development device 160 includes a housing 310 and a cover 311. The housing 310 has an upper opening 312, and screws 330 and a magnetic roller 320 are disposed therein. The upper opening 312 is covered with the cover 311 to prevent the developer from scattering from the housing 310.

In the above development device 160, the cover 311 is mounted to the housing 310 with a screw or the like. Between the housing 310 and the cover 311, an elastic member such as a sponge member is disposed to ensure a sealing performance. In order to improve a sealing performance, it is also possible to adhere the cover 311 to the housing 310. However, the cover 311 has a low rigidity because it is for preventing the toner scattering. Therefore, even if the cover 311 may be adhered to the housing 310, this does not so contribute to the improvement of a strength and a rigidity of the housing 310. In order to improve a strength and a rigidity of the housing 310, it is required to increase a wall thickness of the housing 310 and to use a material having a high Young's module. However, this causes problems such as an increase of cost and a difficulty of working due to the high Young's module.

SUMMARY

In accordance with an aspect of the present disclosure, a development device includes a rotational member and a housing. The rotational member rotates around an axis. In the housing, the rotational member and a toner are stored. The housing includes a lower housing and an upper housing. The lower housing has a concave first storage part having an opened upper face. The upper housing has a concave second storage part having an opened lower face. The first storage part has a first edge portion around the opened upper face. The first edge portion has a first contact face. The second storage part has a second edge portion around the opened lower face. The second edge portion has a second contact face coming into contact with the first contact face. The first contact face and the second contact face are contained in a single plane along respective entire perimeters.

In accordance with an aspect of the present disclosure, an image forming apparatus includes an exposure device which forms an electrostatic latent image on a photosensitive drum; and the development device which develops the electrostatic latent image.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
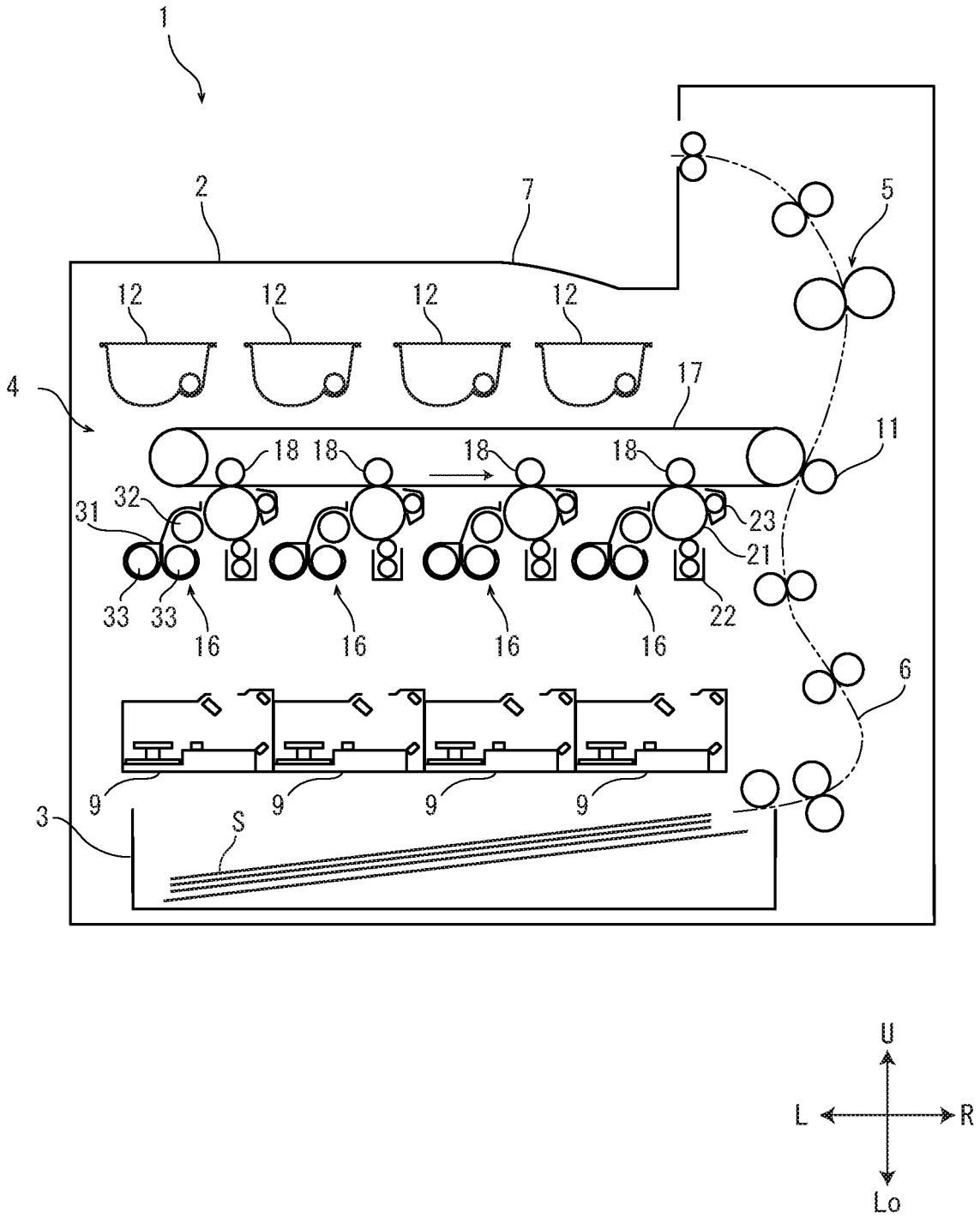
FIG. 1 is a front view schematically showing an inner structure of a printer according to one embodiment of the present disclosure.

Hereinafter, a printer 1 (an example of an image forming apparatus) and a development device 16 according to one embodiment of the present disclosure will be described with reference to the drawings. FIG. is a front view schematically showing an inner structure of the printer 1. In the following description, a near side (a front side) of a paper surface of FIG. 1 is defined to be a front side of the printer 1, and a left-and-right direction is defined based on a direction in which the printer 1 is viewed from the front side. In each figure, U, Lo, L, R, Fr and Rr respectively show an upper side, a lower side, a left side, a right side, a front side and a rear side.

The printer 1 includes a box-shaped casing 2. In the casing 2, a sheet feeding device 3 which feeds a sheet S to a conveyance path 6, an image forming part 4 which forms a toner image on the sheet S, a fixing device 5 which fixes the toner imager on the sheet S and a discharge part 7 which discharges the sheet S on which the toner image is fixed are stored.

The image forming part 4 includes a photosensitive drum 21, a charging device 22, an exposure device 9, a developer container 12, a development device 16, an intermediate transferring belt 17, a primary transferring roller 18, a secondary transferring roller 11 and a cleaning device 23. The photosensitive drum 21 is driven to be rotated. The charging device 22 charges the photosensitive drum 21. The exposure device 9 emits laser light based on an image data to the photosensitive drum 21 to form an electrostatic latent image on the photosensitive drum 21. The developer container 12 supplies a developer containing a toner to the development device 16. The development device 16 develops the electrostatic latent image by the toner to form a toner image. The intermediate transferring belt 17 is wound around a drive roller and a driven roller. The primary transferring roller 18 transfers the toner image to the intermediate transferring belt 17. The secondary transferring roller 11 transfers the toner image on the intermediate transferring belt 17 to the sheet S. The cleaning device 23 cleans the surface of the photosensitive drum 21. The printer 1 is provided with four sets of the photosensitive drum 21, the charging device 22, the exposure device 9, the developer container 12, the development device 16, the primary transferring roller 18 and the cleaning device 23, and configured to form a color image using the toners of four colors. The present disclosure may be applied to an image forming apparatus which forms an image using the toner of one color, or the toners of three or five or more colors.

The development device 16 includes a housing 31, a magnetic roller 32 and two screws 33 (an example of a rotational member). Between the housing 31 and the developer container 12, a developer supply path (not shown) is formed. The developer is a two-component developer containing a non-magnetic toner and a magnetic carrier, for example. The two screws 33 are disposed in the housing 31 parallel to each other. The magnetic roller 32 is disposed parallel to the screws 33, and its outer circumferential face is exposed from the housing to face the outer circumferential face of the photosensitive drum 21.

Next, an image forming operation of the printer 1 will be described. When the printer 1 receives an image data from an exterior computer or the like, the sheet S is fed to the conveyance path 6 from the sheet feeding device 3. Additionally, on the surface of the charged photosensitive drum 21, an electrostatic latent image is formed by the exposure device 9 based on the image data. The developer is supplied to the housing 31 from the developer container 12, and then agitated by the screws 33. The two screws 33 convey the developer in opposite directions to circulate the developer in the housing 31. The developer is carried on the magnetic roller 32 by magnetic force between the carrier and the magnetic roller 32. The toner contained in the carried developer is carried on the electrostatic latent image by a potential difference between the magnetic roller 32 and the photosensitive drum 21. As a result, the toner image is formed.

The toner images formed on the photosensitive drums 21 are overlapped and transferred on the intermediate transferring belt 17 by the primary transferring rollers 18. The toner image transferred on the intermediate transferring belt 17 is transferred on the sheet S by the secondary transferring roller 11, and then fixed on the sheet S by the fixing device 5. The sheet S on which the toner image is fixed is discharged to the discharge part 7.

Figure 2:
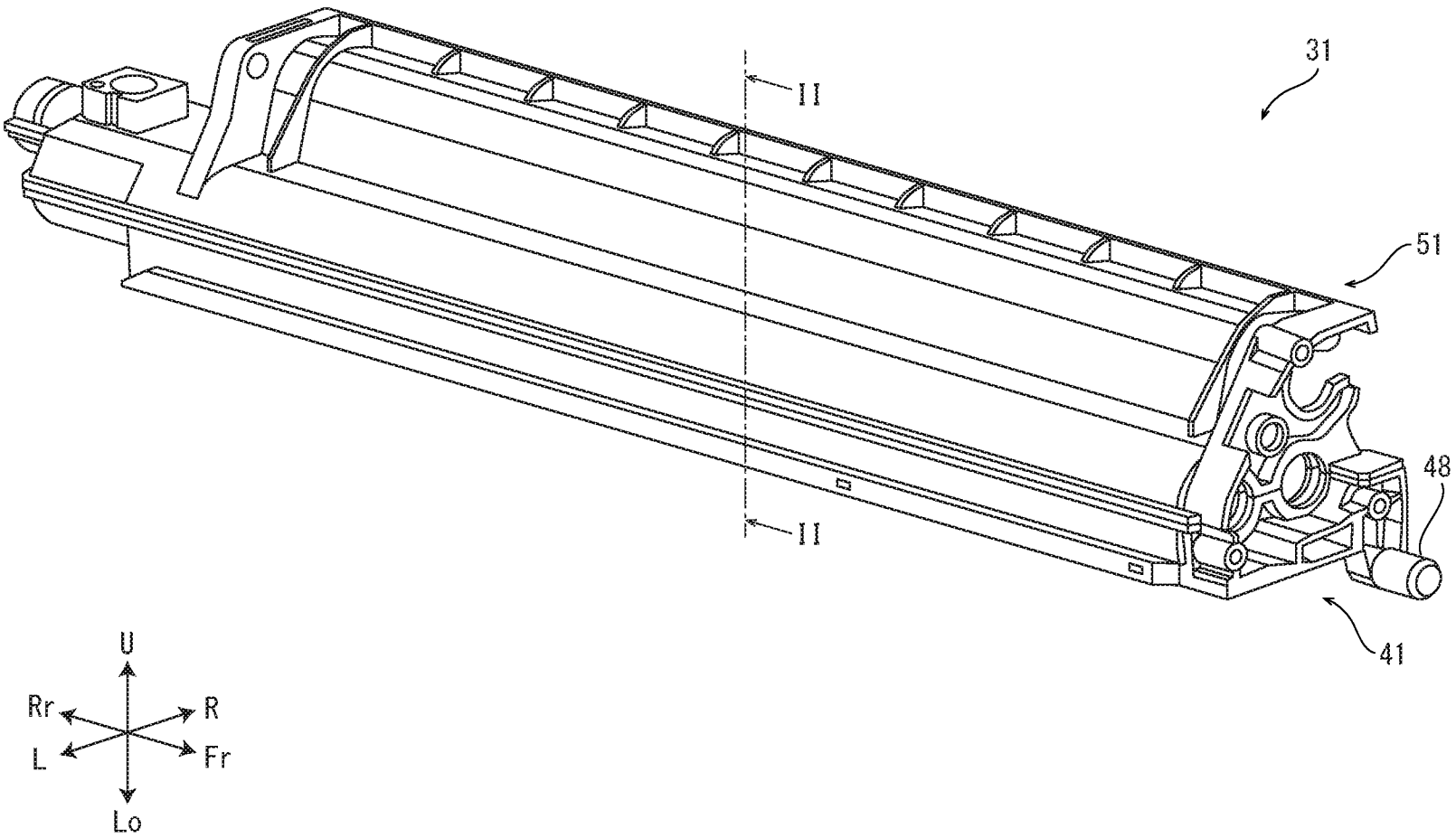
FIG. 2 is a perspective view showing an appearance of a housing of a development device according to the embodiment of the present disclosure.
Figure 3:
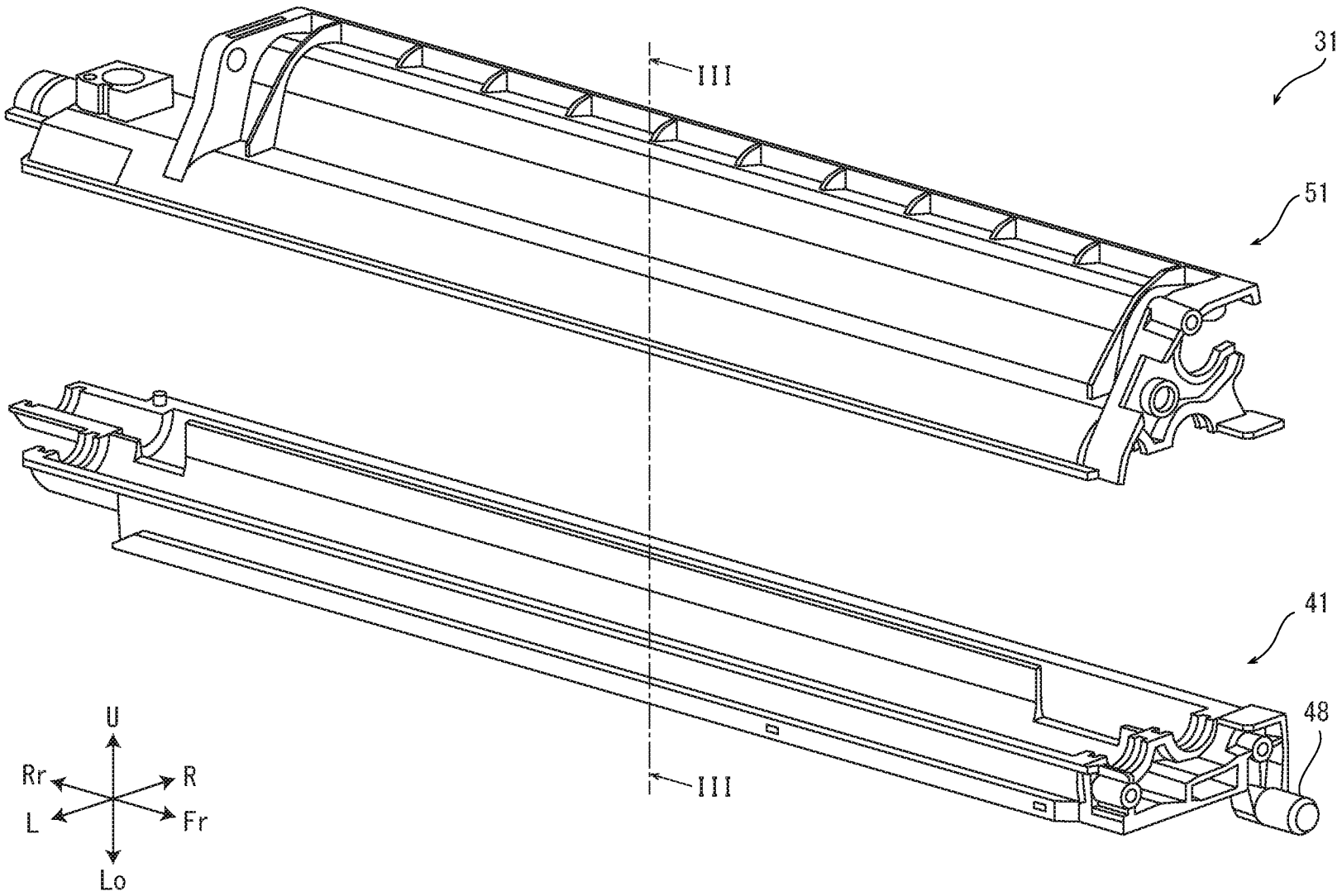
FIG. 3 is a perspective view showing an upper housing and a lower housing which are separated each other, in the development device according to the embodiment of the present disclosure.
Figure 4:
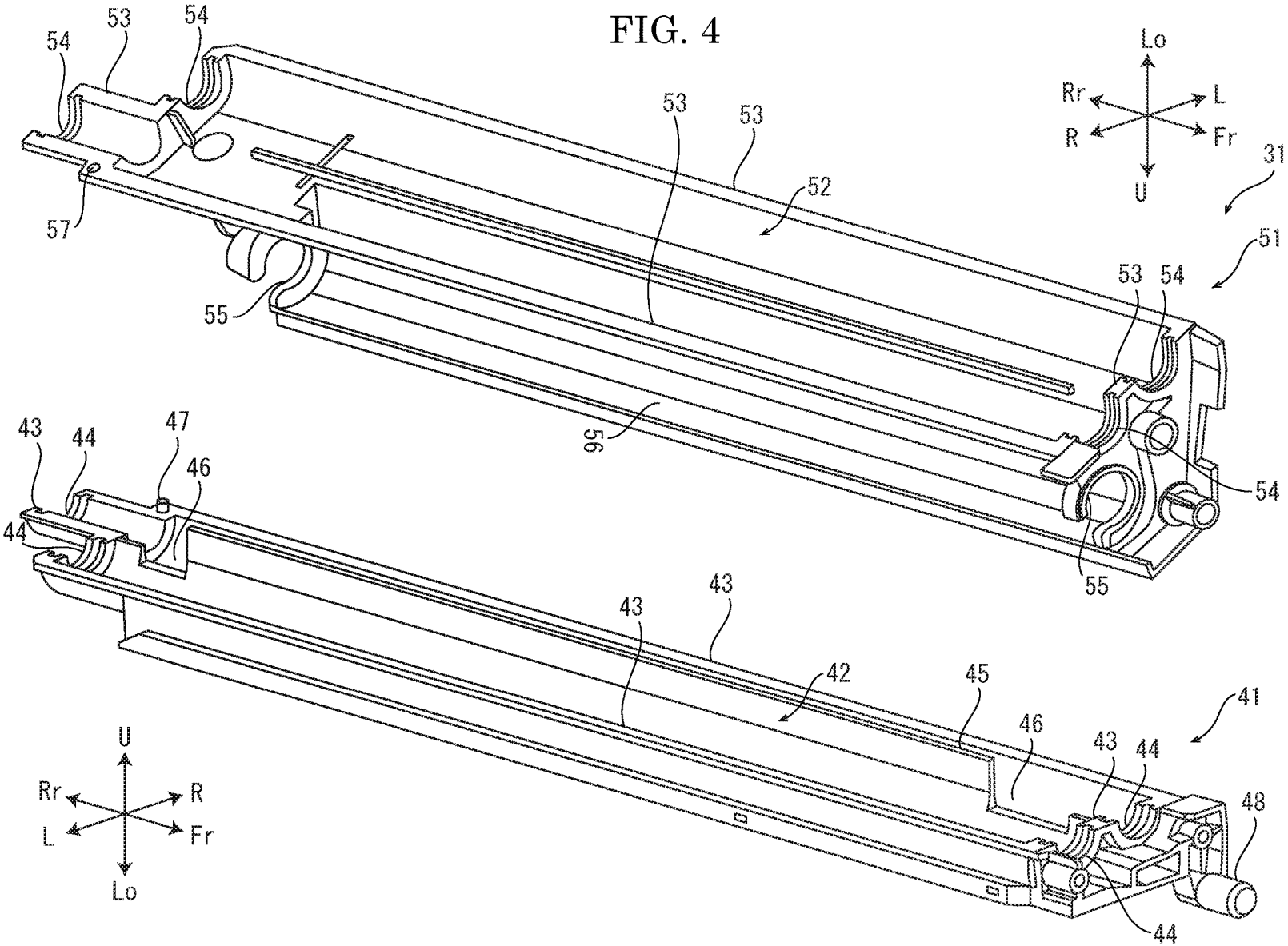
FIG. 4 is a perspective view showing a first edge portion and a second edge portion, in the development device according to the embodiment of the present disclosure.
Figure 5:
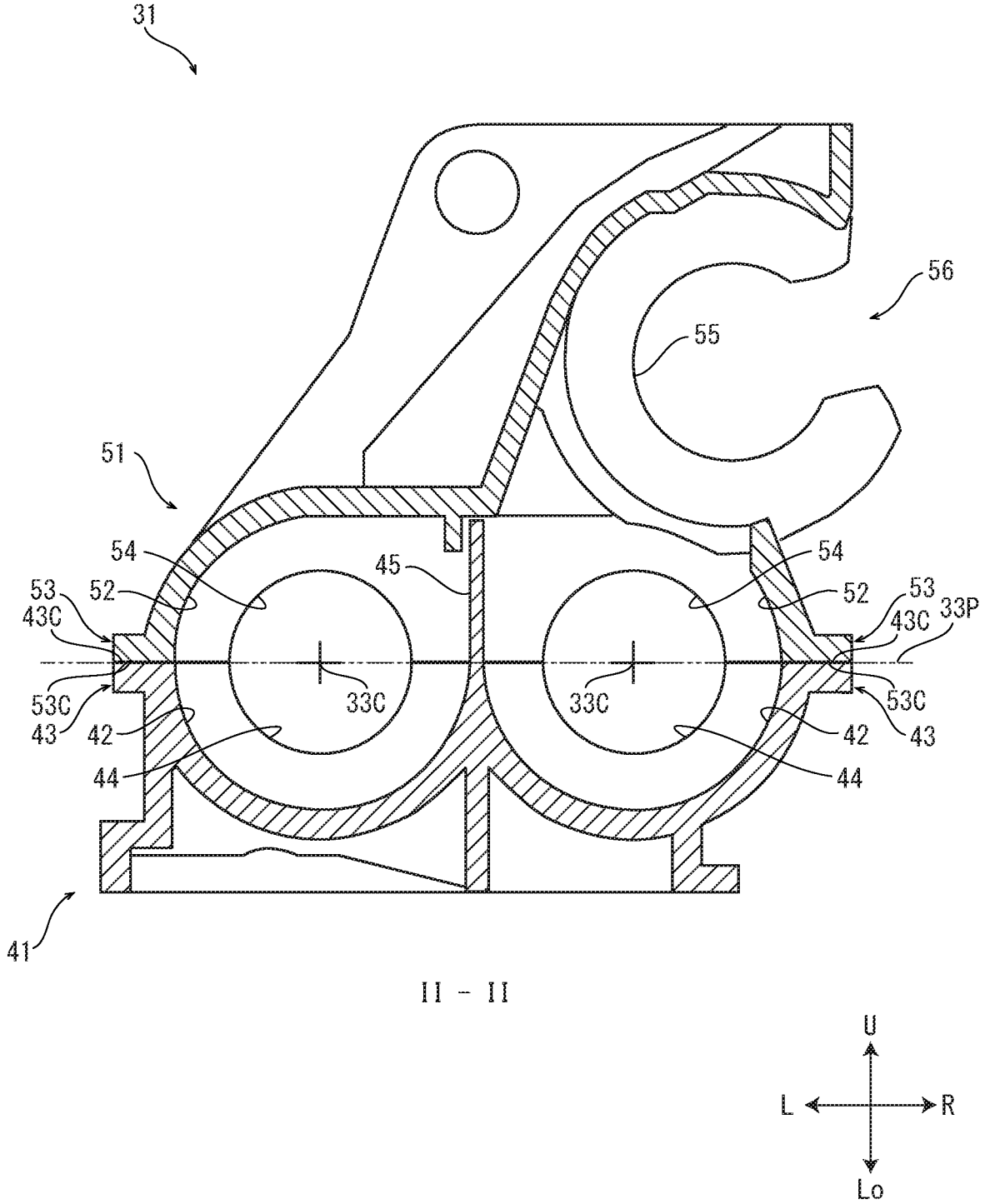
FIG. 5 is a sectional view along the II-II line in FIG. 2.
Figure 6:
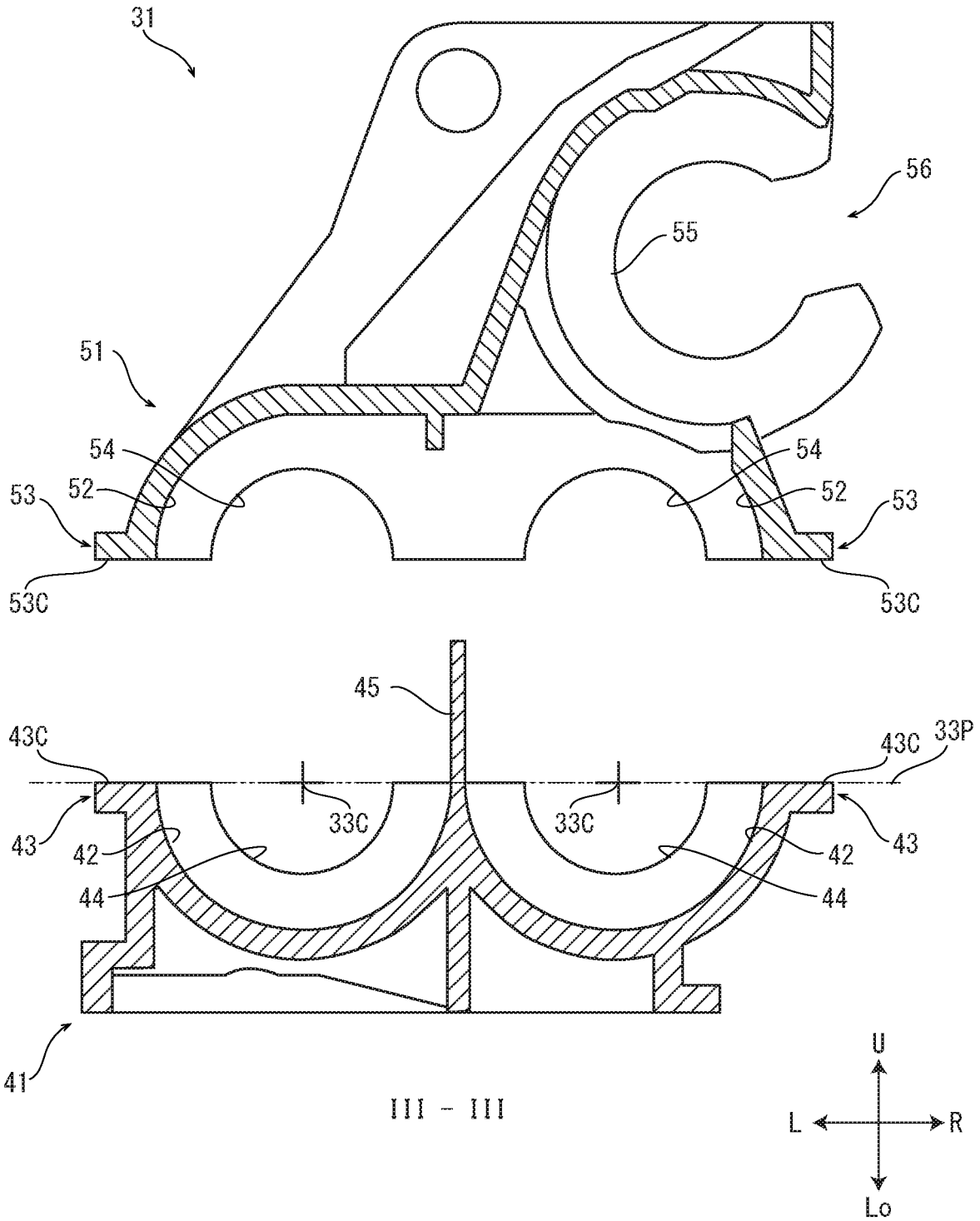
FIG. 6 is a sectional view along the III-III line in FIG. 2.

Next, with reference to FIG. 1 to FIG. 6, the housing 31 of the development device 16 will be described. FIG. 2 is a perspective view showing the appearance of the housing 31 of the development device 16. FIG. 3 is a perspective view showing a lower housing 41 and an upper housing 51 which are separated each other. FIG. 4 is a perspective view showing a first edge portion 43 and a second edge portion 53. FIG. 5 is a sectional view along the II-II line in FIG. 2. FIG. 6 is a sectional view along the III-III line in FIG. 3. FIG. 4 shows the upper housing 51 upside down.

The development device 16 includes the screws 33 each rotating around an axis and the housing 31 in which the screws 33 and the developer are stored. The housing 31 includes a lower housing 41 having a first concave storage part 42 whose upper face is opened and an upper housing 51 having a second concave storage part 52 whose lower face is opened. The upper housing 51 is disposed above the lower housing 41.

As shown in FIG. 2, the housing 31 of the development device 16 has a hollow structure whose longitudinal direction is along the front-and-rear direction. Inside the housing 31, the screws 33 and the magnetic roller 32 are stored. In the housing 31, the developer supplied from the developer container 12 is stored. As shown in FIG. 3, the housing 31 is formed by adhering the upper housing 51 to the lower housing 41. The lower housing 41 and the upper housing 51 are formed by injection molding.

As shown in FIG. 4 to FIG. 6, the lower housing has the first concave storage part 42 whose longitudinal direction is along in the front-and-rear direction. The upper face of the first storage part 42 is opened. The first storage part 42 has a cross section in which two semicircular cross sections are arranged side by side in the left-and-right direction. The first storage part 42 has a partition wall 45 at the center portion in the left-and-right direction extending along the front-and-rear direction. The screws 33 (refer to FIG. 1) are disposed on a left side and a right side of the partition wall 45, respectively. The front end portion and the rear end portion of the housing 31 each has bearing supporting parts 44 to which the bearings of the screws 33 are supported. The bearing supporting part 44 has a semicircular cross section. Between the front end portion of the first storage part 42 and the front end portion of the partition wall 45, and between the rear end portion of the first storage part 42 and the rear end portion of the partition wall 45, the respective gaps 46 are formed. Thus, a circulation path along which the developer is conveyed is formed around the partition wall 45. As shown in FIG. 2 to FIG. 4, from the front end portion of the lower housing 41, a pin 48 protrudes forwardly. From the rear end portion of the lower housing 41, a pin 48 (not shown) protrudes rearwardly.

As shown in FIG. 4, along a first edge portion of the first storage part 42 except the bearing supporting parts 44, a first contact face 43C is formed so as to come into contact with a second contact face 53C of the upper housing 51. As shown in FIG. 5 and FIG. 6, the first contact face 43C is contained in a single plane 33P parallel to the axial centers 33C of the screws 33 over the entire area. The single plane 33P contains the axial centers 33C of the screws 33. The first edge portion 43 is formed with at least one protrusion 47 protruding upwardly.

As shown in FIG. 4 to FIG. 6, the upper housing 51 has the second concave storage part 52 whose longitudinal direction is along in the front-and-rear direction. The lower face of the second storage part 52 is opened. The front end portion and the rear end portion of the upper housing 51 each has bearing supporting parts 54 to which the bearings of the screws 33 are supported. Above the right bearing supporting part 54, a bearing supporting part 55 to which the bearing of the magnetic roller 32 is supported is formed. The bearing supporting part 55 has a semicircular cross section. The second storage part 52 is configured to have a shape to cover the screw 33 (not shown) supported by the left bearing supporting parts 54 and the magnetic roller 32 (not shown) supported by the bearing supporting parts 55 from the upper side. On a right side of the magnetic roller 32, an opening 56 is formed.

As shown in FIG. 4, along a second edge portion 53 of the second storage part 52 except the bearing supporting parts 54, the second contact face 53C is formed so as to come into contact with the first contact face 43C of the lower housing 41. As shown in FIG. 5, when the first contact face 43C comes into contact with the second contact face 53C, the second contact face 53C is contained in the single plane 33P over the entire area. The second edge portion 53 is formed with a hole 57 into which the protrusion 47 of the first edge portion 43 is fitted.

The bearings of the screws 33 are supported by the bearing supporting parts 44 and 54, and then the screws 33 are stored in the first storage part 42. On the first contact face 43C or the second contact face 53C, an adhesive is applied, and the protrusion 47 is fitted into the hole 57. Then, the upper housing 51 is positioned with respect to the lower housing 41, and the lower housing 41 and the upper housing 51 are adhered. The screws 33 are stored in a space formed by the first storage part 42 and the second storage part 52. The bearings of the magnetic roller 32 are supported by the bearing supporting parts 55. The pin 48 of the lower housing 41 is inserted into a supporting hole (not shown) of the casing 2. The housing 31 is supported by the casing 2 in a turnable manner around the pins 48, and the posture of the development device 16 is adjusted such that a distance between the magnetic roller 32 and the photosensitive drum 21 becomes an optimum value.

According to the development device 16 of the above described embodiment, the first contact face 43C of the lower housing 41 and the second contact face 53C of the upper housing 51 are contained in the single plane 33P over the entire area. Therefore, compared with a case where a less rigid cover is mounted to the opened upper face of the housing, the lower hosing 41 and the upper housing 51 are integrated over the entire perimeter (except the opening 56) so that a strength and a rigidity of the housing 31 is improved.

Additionally, in a case where the housing 31 is supported in a turnable manner around the pins 48, twist and distortion of the housing 31 may affect a positioning accuracy of the magnetic roller 32. However, according to the development device 16 of the present embodiment, a torsional rigidity and a bending rigidity of the housing 31 are improved so that the twist and the distortion of the housing 31 hardly occur and the positioning accuracy of the magnetic roller 32 is improved. Additionally, the degree of freedom in material selection is increased, and the cost can be decreased by decreasing the average thickness.

Additionally, according to the development device 16 of the present embodiment, the first contact face 43C and the second contact face 53C are contained in the single plane 33P over the entire area. Accordingly, compared with a case where the first contact face 43C and the second contact face 53C are contained in multiple planes, a gap is hardly formed between the first contact face 43C and the second contact face 53C, and a sealing performance of the housing 31 is improved. Furthermore, it becomes possible to decrease the cost by reducing the use of seal material such as sponge. Additionally, the first contact face 43C and the second contact face 53C are contained in the single plane 33P containing the axial centers 33C of the screws 33. The first storage part 42, the second storage part 52, the bearing supporting parts 44 and 54 are formed such that an opening area is narrowed in the depth direction. Then, when the upper housing 51 and the lower housing 41 are formed by injection molding, an advantage that the dye is easily drawn out can be obtained.

According to the development device 16 of the present embodiment, the housing 31 is formed by adhering the lower housing 41 to the upper housing 51. Accordingly, compared with a case where both the housings 41 and 51 are fastened by a screw or the like, a sealing performance of the housing 31 is improved.

Therefore, according to the development device 16 of the present embodiment, it becomes possible to improve a sealing performance, a strength and a rigidity of the housing 31.

According to the development device 16 of the present embodiment, the first contact face 43C is contained in the single plane 33P over the entire area. Accordingly, compared with a case where the first contact face 43C is contained in multiple planes, it becomes possible to easily design the dye for injection molding.

The above embodiment may be modified as follows.

Figure 7:
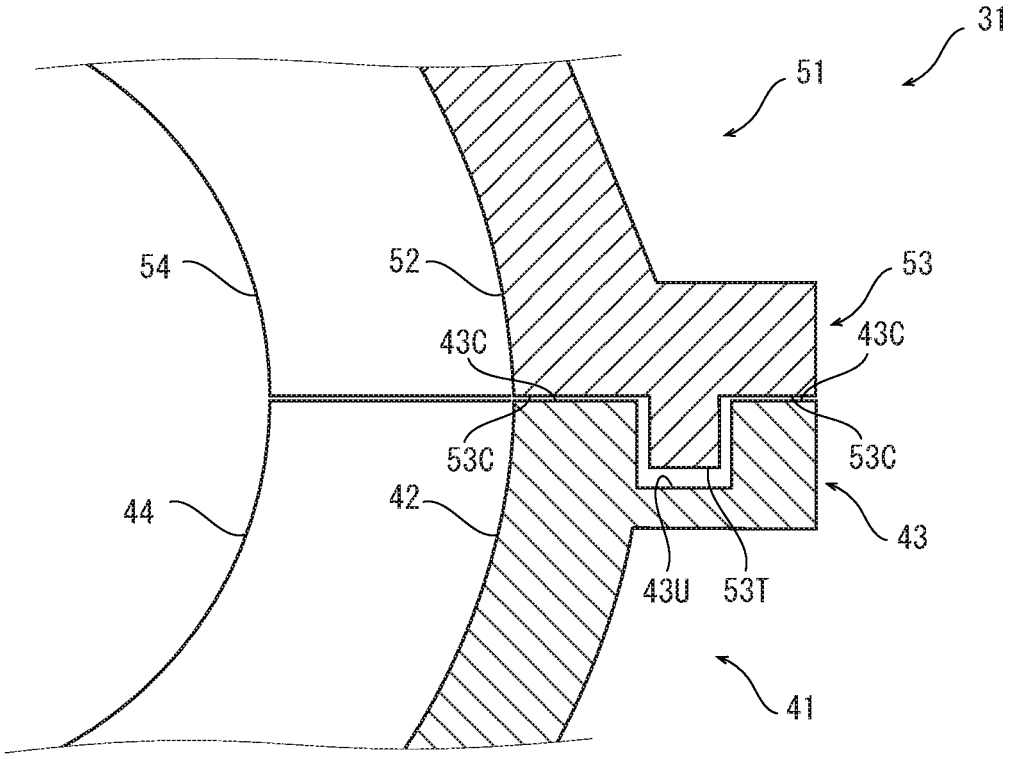
FIG. 7 is a sectional view showing the housing of a modified example, in the development device according to the embodiment of the present disclosure.
Figure 7:
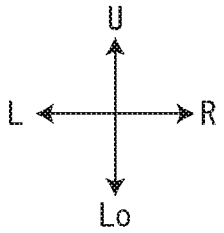

FIG. 7 is a sectional view showing the housing 31 of the modified example. FIG. 7 shows the right first and second edge portions 43 and 53 and their vicinity among the left and right first and second edge portions 43 and 53 shown on a II-II sectional view in FIG. 5. The left first and second edge portions 43 and 53 have the same structure except that the left and right sides are reverse. As shown in figure, the first edge portion 43 may have a first recess 43U extending along the first edge portion 43, and the second edge portion 53 may have a second protrusion 53T fitted into the first recess 43U. According to the configuration, an adherable area and a shear strength in the left-and-right direction are improved so that an adhesive strength and a sealing performance are improved. All the first contact face 43C, the second contact face 53C, the first recess 43U and the second protrusion 54T may be adhered. Alternatively, the first recess 43U and the second protrusion 53T may be only adhered. In this case, the first contact face 43C and the second contact face 53C are brought into tightly contact without an adhesive so that a sealing performance of the housing 31 is improved. Additionally, the adhesive does not leak in the first storage part 42 so that it is possible to prevent the adhesive solidified in the first storage part 42 from interfering with the agitation and the conveyance of the developer.

Figure 8:
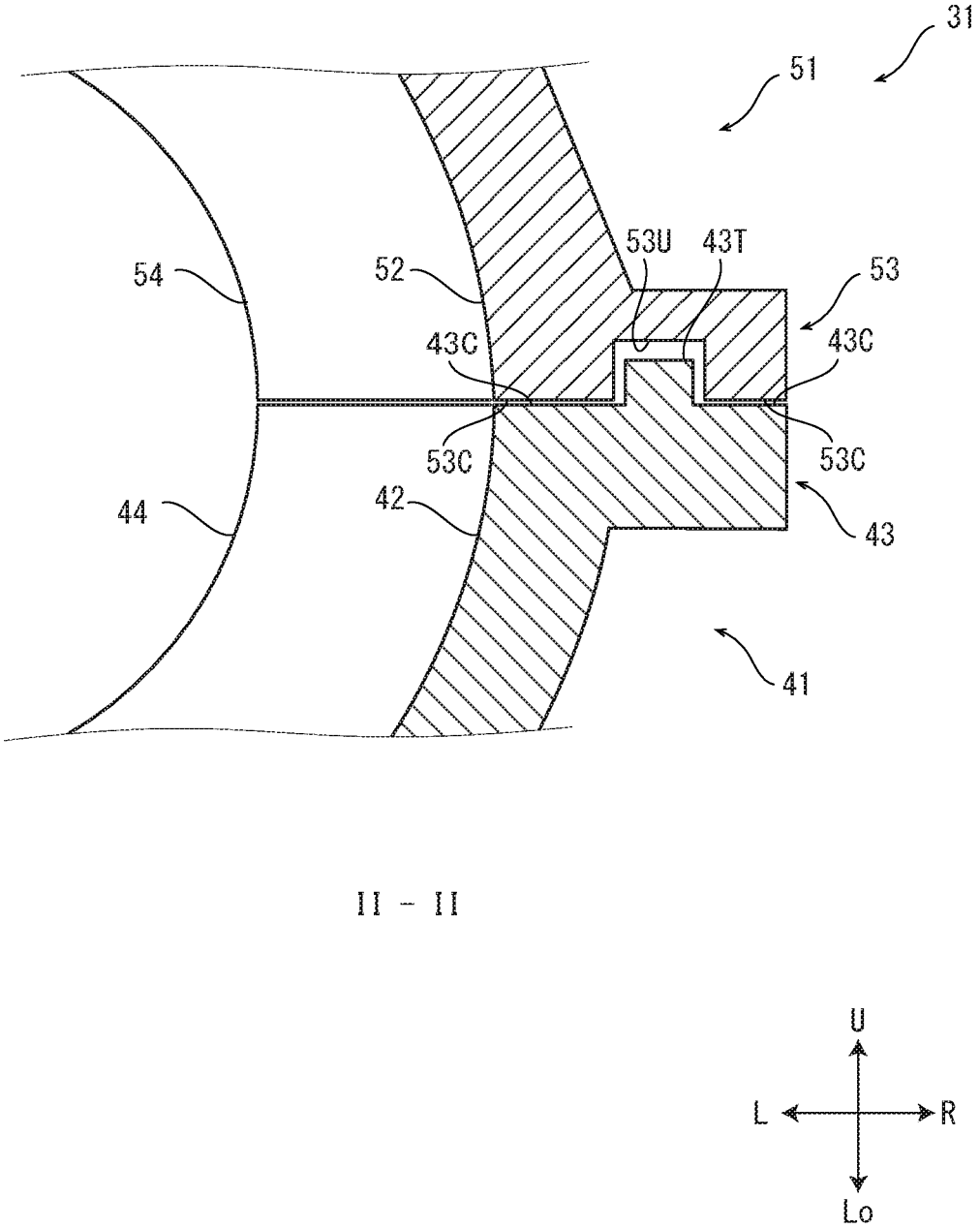
FIG. 8 is a sectional view showing the housing of a modified example, in the development device according to the embodiment of the present disclosure.

FIG. 8 is a sectional view showing the housing 31 of the modified example. As shown in figure, the first edge portion 43 may have a first protrusion 43T extending along the first edge portion 43, and the second edge portion 53 may have a second recess 53U into which the first protrusion 43T is fitted. According to the configuration, the same effect as the modified example shown in FIG. 7 can be obtained.

Figure 9:
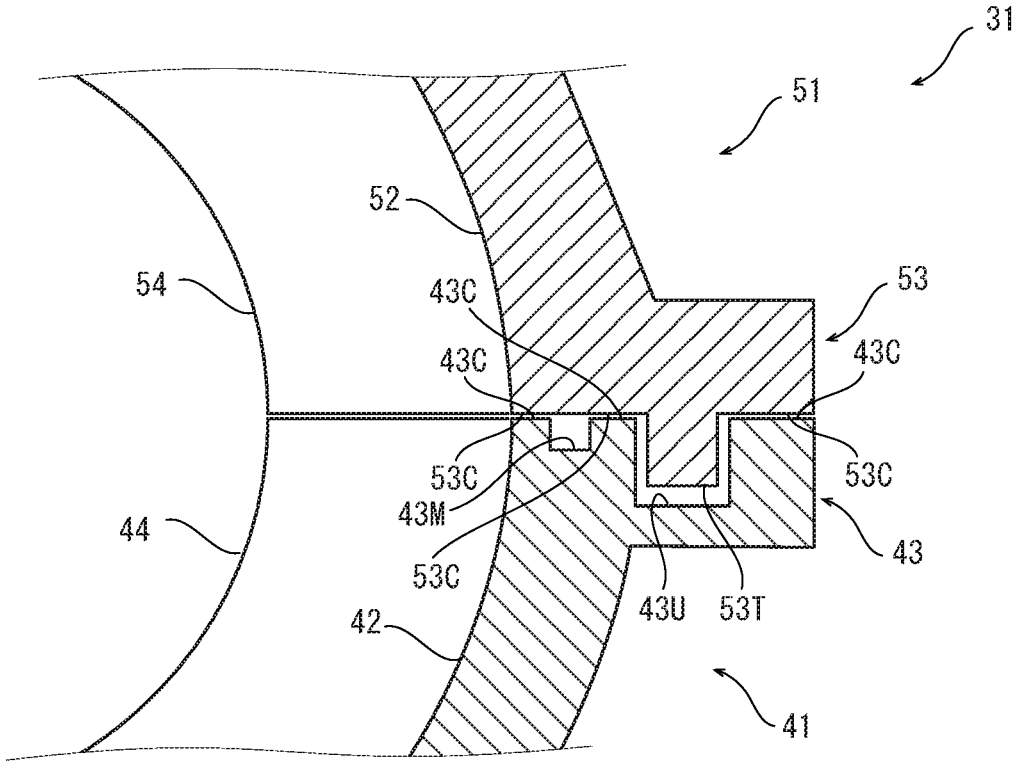
FIG. 9 is a sectional view showing the housing of a modified example, in the development device according to the embodiment of the present disclosure.
Figure 9:
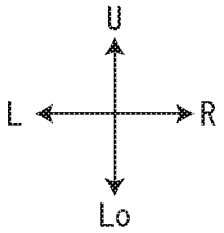

FIG. 9 is a sectional view showing the housing 31 of the modified example. As shown in figure, the first edge portion 43 may have a groove 43M extending along the first recess 43U inside the first recess 43U. According to the configuration, the excess adhesive flows into the groove 43M so that the leakage of the adhesive to the first storage part 42 is inhibited. Additionally, a sealing performance of the housing 31 is improved.

Figure 10:
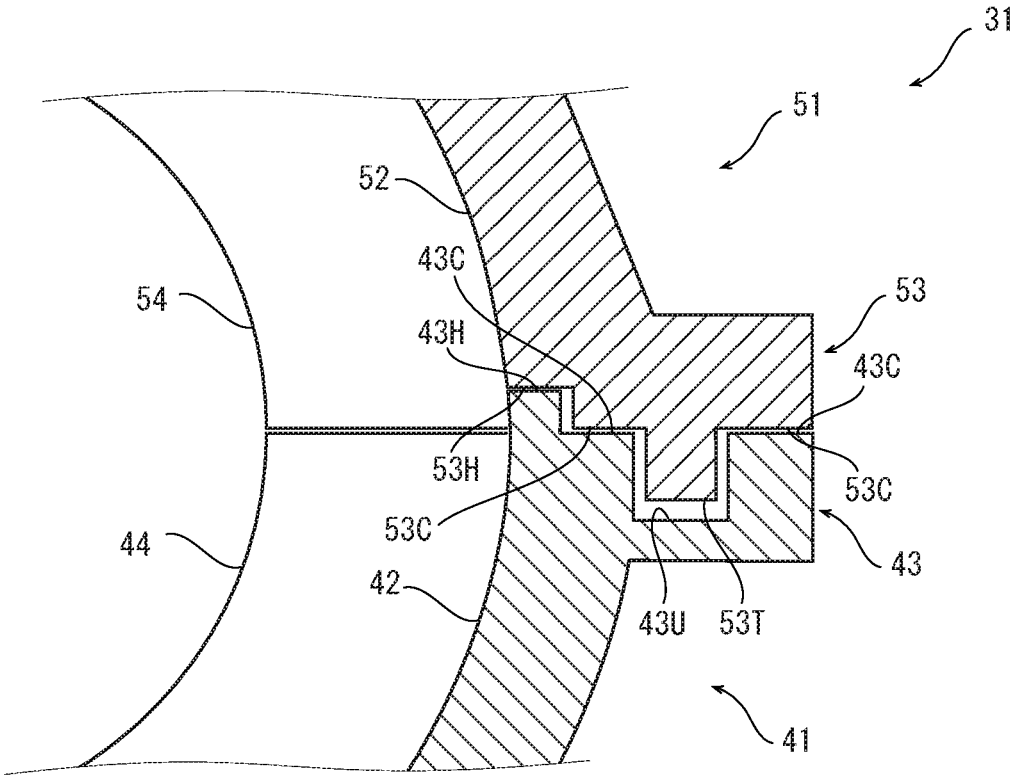
FIG. 10 is a sectional view showing the housing of a modified example, in the development device according to the embodiment of the present disclosure.
Figure 10:
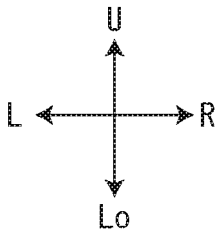

FIG. 10 is a sectional view showing the housing 31 of the modified example. As shown in figure, the first edge portion 43 may have a first step 43H inside the first recess 43U, and the second edge portion 53 may have a second step 53H inside the second protrusion 53T. The first step 43H is formed such that the first storage part 42 side is high. The second step 53H is formed such that the second storage part 52 side is high. According to the configuration, the excess adhesive is blocked by the first step 43H so that the leakage of the adhesive to the first storage part 42 is inhibited. Additionally, a sealing performance of the housing 31 is improved.

Figure 11:
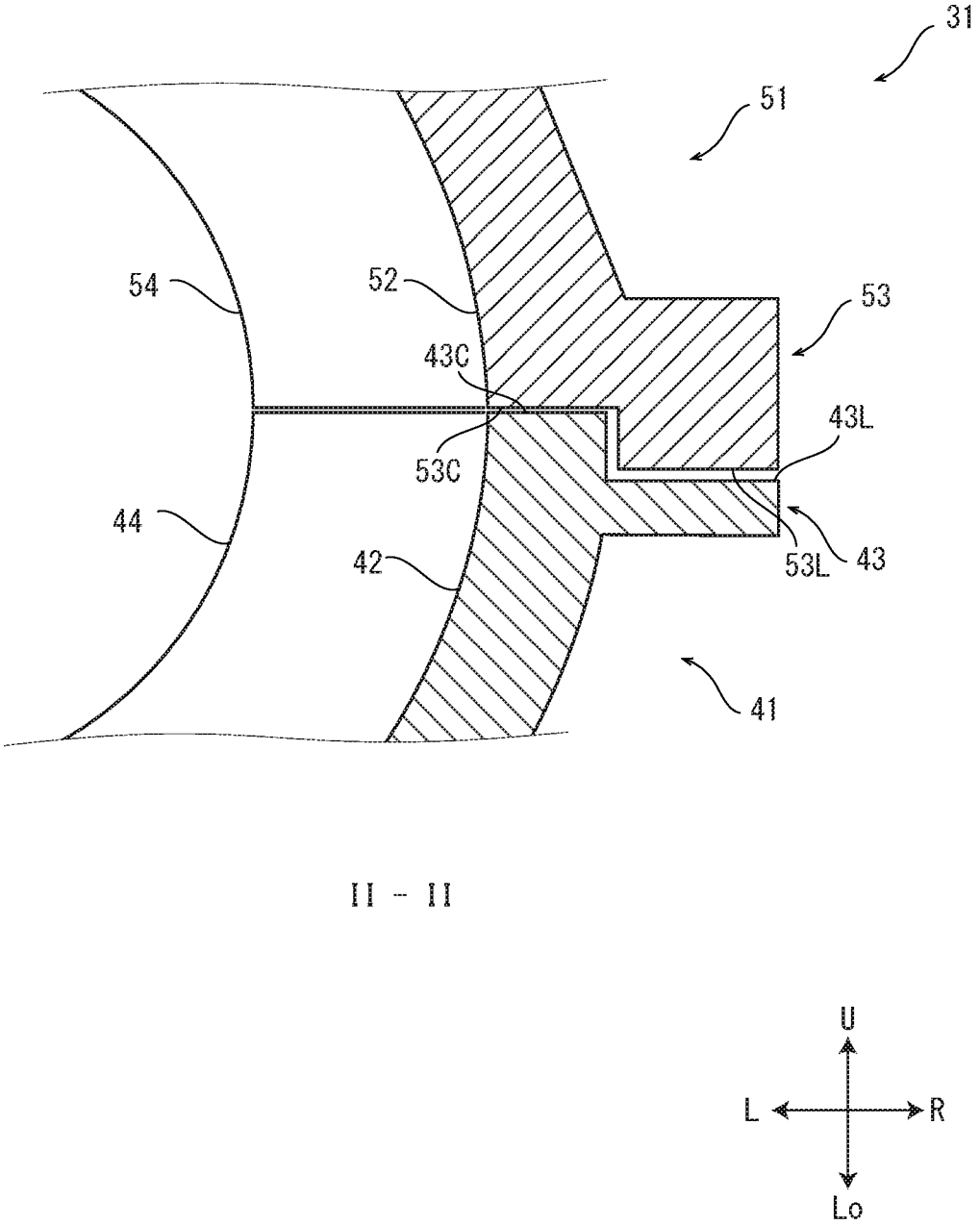
FIG. 11 is a sectional view showing the housing of a modified example, in the development device according to the embodiment of the present disclosure.

FIG. 11 is a sectional view showing the housing 31 of the modified example. As shown in figure, the first edge portion 43 may have a third step 43L outside the first contact face 43C, and the second edge portion 53 may have a fourth step 53L outside the second contact face 53C. The third step 43L is formed to be lower than the first contact face 43C, and the fourth step 53L is formed to be lower than the second contact face 53C. According to the configuration, an adherable area and a shear strength in the left-and-right direction are increased so that an adhesive strength and a sealing performance are improved. All the first contact face 43C, the second contact face 53C, the third step 43L and the fourth step 53L may be adhered. Alternatively, the third step 43L and the fourth step 53L may be only adhered. In this case, the first contact face 43C and the second contact face 53C are brought into tightly contact without an adhesive, so that a sealing performance of the housing 31 is improved. Additionally, the adhesive does not leak in the first storage part 42 so that the adhesive solidified in the first storage part 42 does not interfere with the agitation and the conveyance of the developer.

Figure 12:
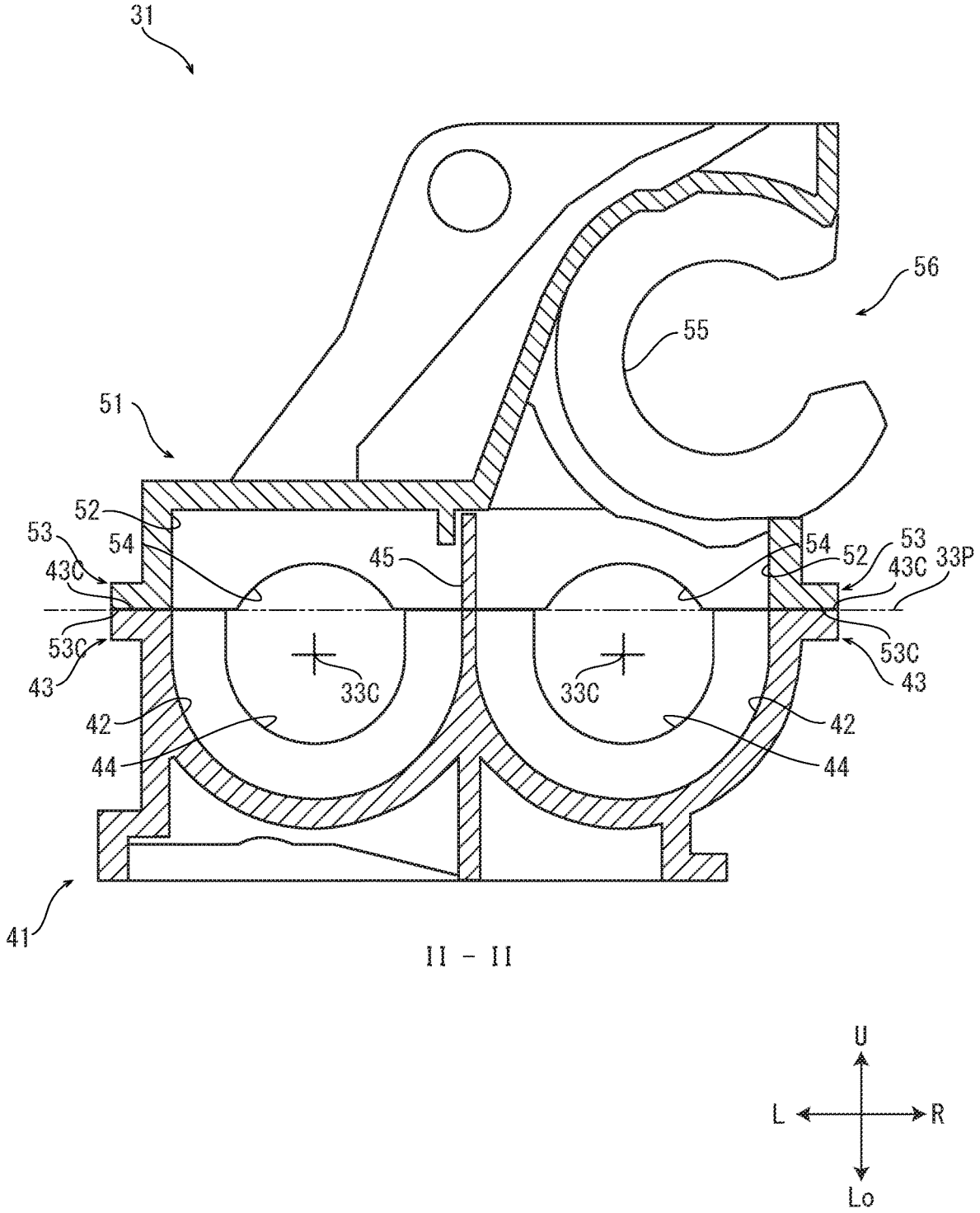
FIG. 12 is a sectional view showing the housing of a modified example, in the development device according to the embodiment of the present disclosure.
Figure 13A:
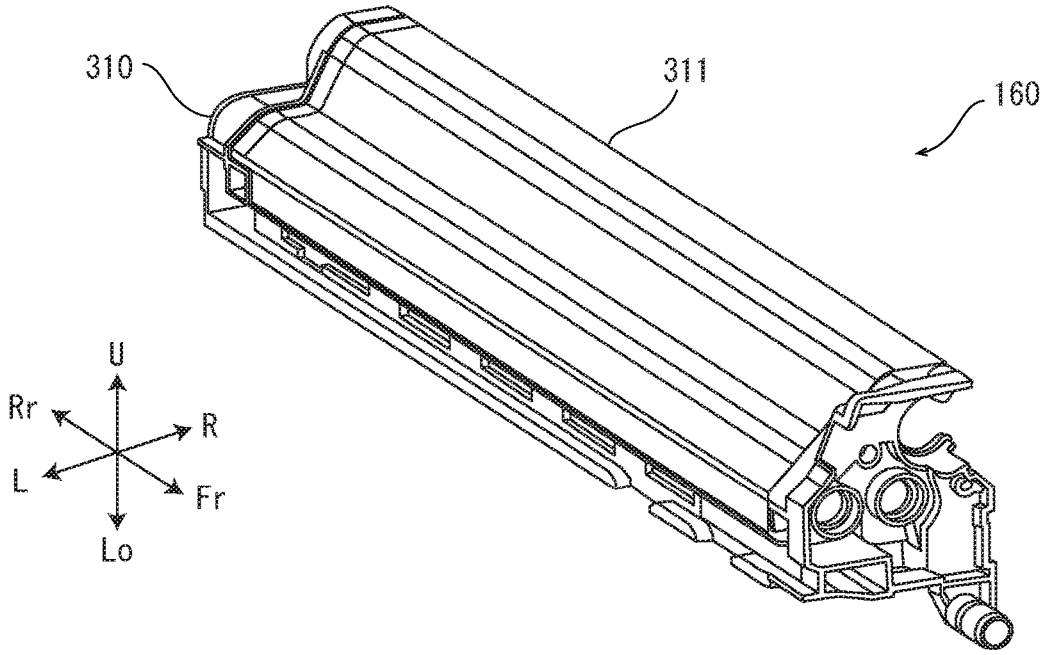
FIG. 13A prior art
FIG. 13A is a perspective view showing an appearance of a conventional development device.
Figure 13B:
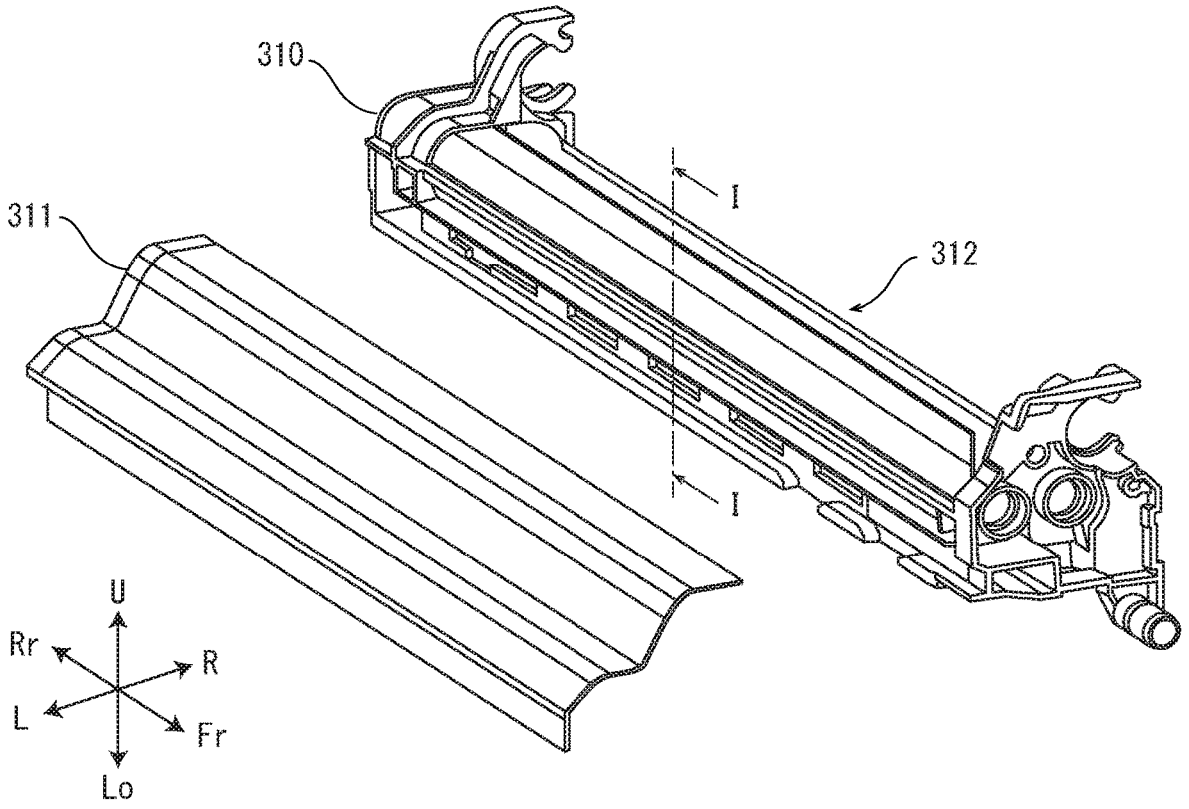
FIG. 13B prior art
FIG. 13B is a perspective view showing a housing from which a cover is removed, in the conventional development device.
Figure 14:
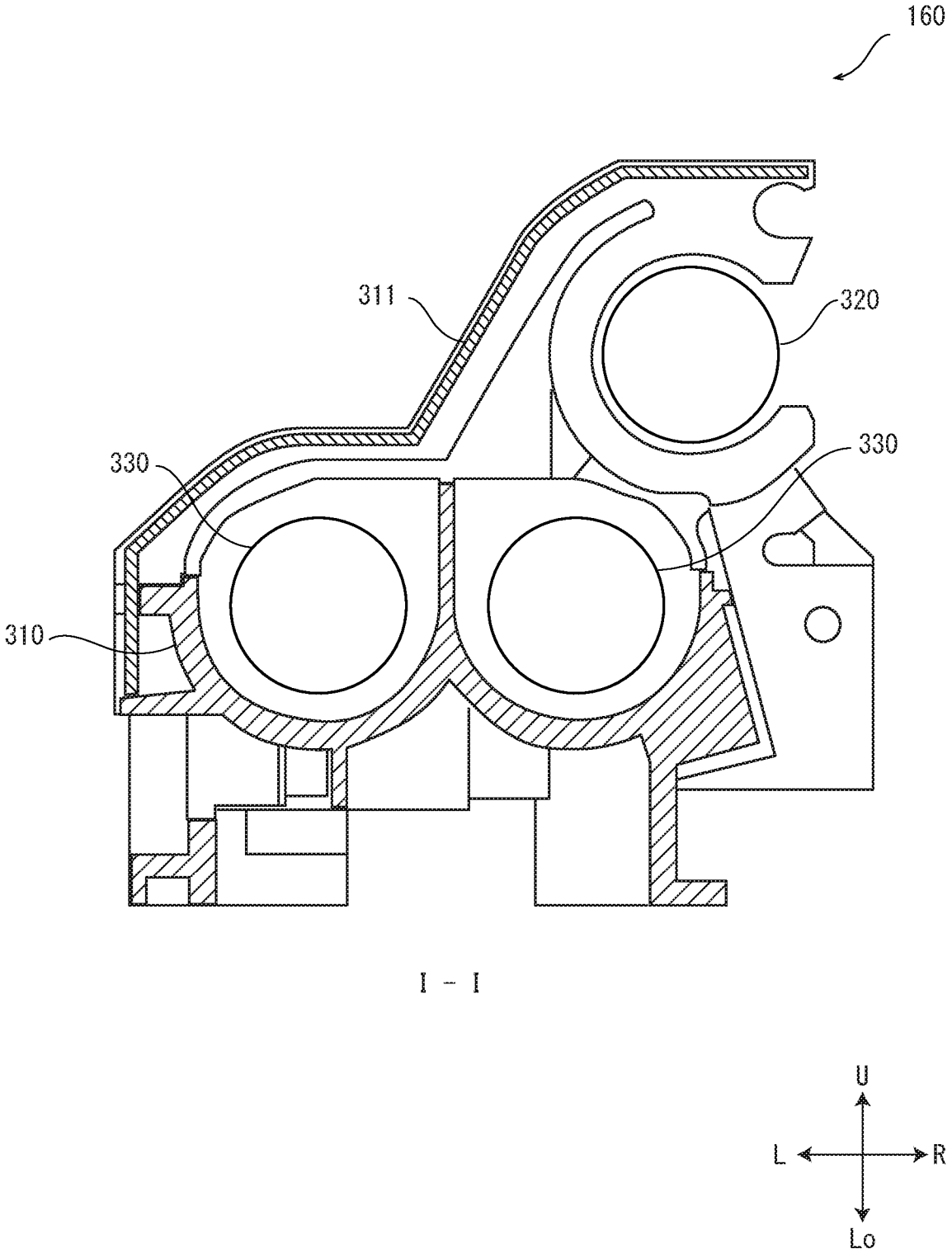
FIG. 14 prior art
FIG. 14 is a sectional view along the I-I line in FIG. 13B.

FIG. 12 is a sectional view showing the housing 31 of the modified example. In the example, the upper portions of the inner faces of the first storage part 42 and the second storage part 52 above the axial centers 33C of the screws 33 are formed to be perpendicularly. The first contact face 43C is formed above the axial centers 33C of the screws 33, and contained in the single plane 33P parallel to the axial centers 33C of the screws 33. According to the configuration, it becomes possible to improve a sealing performance, a strength and a rigidity of the housing 31.

The first contact face 43C and the second contact face 53C may be contained in the single plane 33P not parallel to the axial centers 33C of the screws 33.

In the above embodiment, the screw 33 is an example of the rotational member. However, the magnetic roller 32 or a development roller of a touchdown type development device which supplies the toner to the photosensitive drum from the magnetic roller via the development roller may be an example of the rotational member.

The invention claimed is:

1. A development device comprising:

a rotational member rotating around an axis; and a housing in which the rotational member and a toner are stored, wherein the housing includes a lower housing having a concave first storage part having an opened upper face, and an upper housing having a concave second storage part having an opened lower face, the first storage part has a first edge portion around the opened upper face, the first edge portion has a first contact face, the second storage part has a second edge portion around the opened lower face, the second edge portion has a second contact face coming into contact with the first contact face, and the first contact face and the second contact face are contained in a single plane containing an axial center of the rotational member along respective entire perimeters.

2. The development device according to claim 1, wherein the first edge portion and the second edge portion each has a portion along an axial direction of the rotational member, and the portion along the axial direction is formed to be protruded outwardly.

3. The development device according to claim 1, wherein the first contact face and the second contact face are contained in the single plane along a horizontal direction.

4. An image forming apparatus comprising:

an exposure device which forms an electrostatic latent image on a photosensitive drum; and the development device according to claim 1, which develops the electrostatic latent image.

5. A development device comprising:

a rotational member rotating around an axis; and a housing in which the rotational member and a toner are stored, wherein the housing includes a lower housing having a concave first storage part having an opened upper face; and an upper housing having a concave second storage part having an opened lower face, the first storage part has a first edge portion around the opened upper face, the first edge portion has a first contact face, the second storage part has a second edge portion around the opened lower face, the second edge portion has a second contact face coming into contact with the first contact face, the first contact face and the second contact face are contained in a single plane along respective entire perimeters, the first edge portion has a first recess or a first protrusion extending along the first edge portion, the second edge portion has a second protrusion which is fitted into the first recess or a second recess into which the first protrusion is fitted, at least the first recess and the second protrusion or the first protrusion and the second recess are adhered by an adhesive, and the first edge portion has a groove, extending along the first recess or the first protrusion, inside the first recess or the first protrusion.

6. A development device comprising:

a rotational member rotating around an axis; and a housing in which the rotational member and a toner are stored, wherein the housing includes a lower housing having a concave first storage part having an opened upper face; and an upper housing having a concave second storage part having an opened lower face, the first storage part has a first edge portion around the opened upper face, the first edge portion has a first contact face, the second storage part has a second edge portion around the opened lower face, the second edge portion has a second contact face coming into contact with the first contact face, the first contact face and the second contact face are contained in a single plane along respective entire perimeters, the first edge portion has a first recess or a first protrusion extending along the first edge portion, the second edge portion has a second protrusion which is fitted into the first recess or a second recess into which the first protrusion is fitted, at least the first recess and the second protrusion or the first protrusion and the second recess are adhered by an adhesive, the first edge portion has a first step inside the first recess or the first protrusion, the first step formed such that a side of the first storage part is high, and the second edge portion has a second step inside the second protrusion or the second recess, the second step formed such that a side of the second storage part is high.

7. A development device comprising:

a rotational member rotating around an axis; and a housing in which the rotational member and a toner are stored, wherein the housing includes a lower housing having a concave first storage part having an opened upper face; and an upper housing having a concave second storage part having an opened lower face, the first storage part has a first edge portion around the opened upper face, the first edge portion has a first contact face, the second storage part has a second edge portion around the opened lower face, the second edge portion has a second contact face coming into contact with the first contact face, the first contact face and the second contact face are contained in a single plane along respective entire perimeters, the first edge portion has a third step outside the first contact face, the third step formed to be lower than the first contact face, the second edge portion has a fourth step outside the second contact face, the fourth step formed to be lower than the second contact face, and at least the third step and the fourth step are adhered by an adhesive.

* * * * *